United States Patent [19]

Lowe et al.

[11] Patent Number: 4,771,882

[45] Date of Patent: Sep. 20, 1988

[54] CIGARETTE PACKAGE WITH SPACER

[75] Inventors: Byron L. Lowe, Prospect; Thomas T. Tudor, Crestwood; Chris P. Radley, Louisville, all of Ky.

[73] Assignee: Brown & Williamson Tobacco Corporation, Louisville, Ky.

[21] Appl. No.: 65,745

[22] Filed: Jun. 24, 1987

[51] Int. Cl.[4] ..... B65B 19/20

[52] U.S. Cl. ..... 206/268; 206/271; 206/814

[58] Field of Search ..... 206/814, 271, 273, 274, 206/275, 268, 45.14; 229/199, 160.2, 146

[56] References Cited

U.S. PATENT DOCUMENTS

| | | | |
|---|---|---|---|
| 1,122,641 | 12/1914 | Smith et al. | 53/173 X |
| 1,452,692 | 4/1923 | Lazaga | 53/157 X |
| 1,600,438 | 9/1926 | Tiffany | 206/814 X |
| 1,964,925 | 7/1934 | Meyer-Jagenberg | 53/157 X |
| 2,031,363 | 2/1936 | Erikson | 206/269 X |
| 3,058,581 | 10/1962 | Keating | 206/259 X |
| 3,081,867 | 3/1963 | Corey | 206/259 X |
| 3,948,115 | 4/1976 | Seragnoli | 53/148 X |

*Primary Examiner*—James F. Coan

*Attorney, Agent, or Firm*—Charles G. Lamb

[57] ABSTRACT

A cigarette package includes a plurality of undersized cigarettes which do not entirely fill the cigarette package. The cigarettes are arranged in an orderly group such as, for example, two rows of ten cigarettes each. As is conventional practice, the group of cigarettes is bundled in a foil wrap to keep the cigarettes fresh, and this foil bundle of grouped cigarettes is located in an outer package.

A planar spacer is located between the foil bundle and one side wall of the package to take up the space difference between the depth of the foil bundle and depth of the package. An apparatus for installing the spacer includes a first conveyor path for moving foil bundles of grouped cigarettes in single file and a second conveyor path for moving foil bundles of grouped cigarettes in single file each stacked on a spacer. The spacers are placed on the second conveyor one at a time so that they move therealong in single file. A transfer device moves the foil bundles of cigarettes one at a time from the first conveyor path to the second conveyor path in overlaying relationship to a spacer moving on the second conveyor. Each foil bundle and spacer set is then installed in a package in a conventional manner.

3 Claims, 2 Drawing Sheets

CIGARETTE PACKAGE WITH SPACER

BACKGROUND OF THE INVENTION

1. Field of the Invention

The present invention relates to cigarette packages and packaging machines, and more particularly to a cigarette package having a spacer therein and an apparatus for installing a spacer in the ciagarette package.

2. Description of the Prior Art

Until rcently, cigarettes have been made with a typical or standard circumferential dimension of approximately 25 mm and packaged with twenty cigarettes per package. Slim or thin cigarettes having a circumferential dimension smaller than the more typical or conventional cigarettes are becoming popular. In addition, it is contemplated that fewer than twenty standard size cigarettes can be packaged in a pack. These changing preferences among smokers result in certain practical problems in the packages and packaging techniques. The individual cigarette packages are required to have a tax stamp applied thereto at the top or bottom end. The tax stamps are applied by stamping machines of known conventional construction, and the tax stamps themselves are of a defined minimum size. Therefore, regardless of the size or number of cigarettes in a package, the top and/or bottom end of the package must be of a minimum transverse or package depth dimension sufficient to receive the tax stamp. However, when cigarettes of a very small circumferential dimension are included in such a package in a reasonable or conventional quantity, there is a volume or space within the package left vacant. This is unacceptable because the thusly packaged smaller than typical cigarettes would move within the package.

SUMMARY OF THE INVENTION

The present invention recognizes these problems and provides a straightforward solution.

It is an object of the present invention to provide a cigarette package having a spacer therein to take up the space between the cigarettes and package wall.

It is an object of the present invention to provide a cigarette package having a spacer where the spacer is visually inconspicuous.

It is another object of the invention to provide an apparatus and method for installing a spacer in a cigarette package.

More particularly, the present invention provides a cigarette package comprising an outer enclosure, a foil enclosed bundle of grouped cigarettes located within the outer enclosure, and a planar spacer located within the outer enclosure between the foil bundle of grouped cigarettes and one wall of the outer enclosure.

The present invention further provides an apparatus for placing a spacer in a cigarette package comprising a first conveyor path for moving foil enclosed bundles of cigarettes therealong, a second conveyor path for moving foil enclosed or foil wrapped or foil enwrapped foil bundles of grouped cigarettes each stacked on top of a spacer in a single file therealong, means for placing spacers one at a time onto the second conveyor path, and means for moving the foil bundles of grouped cigarettes one at a time from the first conveyor path to the second conveyor path in overlaying stacked relationships on top of a different one of the spacers moving on the second conveyor path.

The present invention still further provides a method for placing a spacer in a cigarette package comprising the steps of depositing spacers one at a time only a continuously moving conveyor path, depositing a foil enclosed bundle of grouped cigarettes on top of each spacer as the spacers continue to move on the conveyor path, and installing each set of a foil bundle of grouped cigarettes and a spacer into an outer enclosure.

DESCRIPTION OF THE DRAWINGS

The present invention will become even more clear upon reference to the following detailed disclosure in conjunction with the accompanying drawing in which like numerals refer to like parts and wherein.

DETAILED DESCRIPTION OF THE PREFERRED EMBODIMENT

Figure 1:
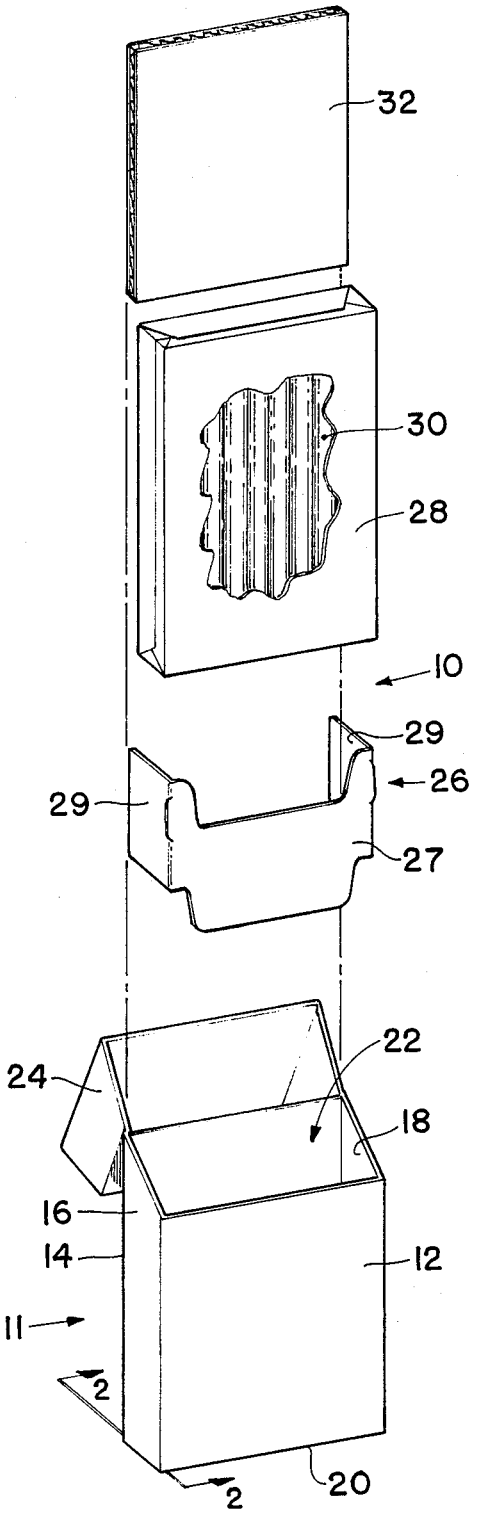
FIG. 1 is an exploded perspective view of a cigarette package of the present invention.
Figure 2:
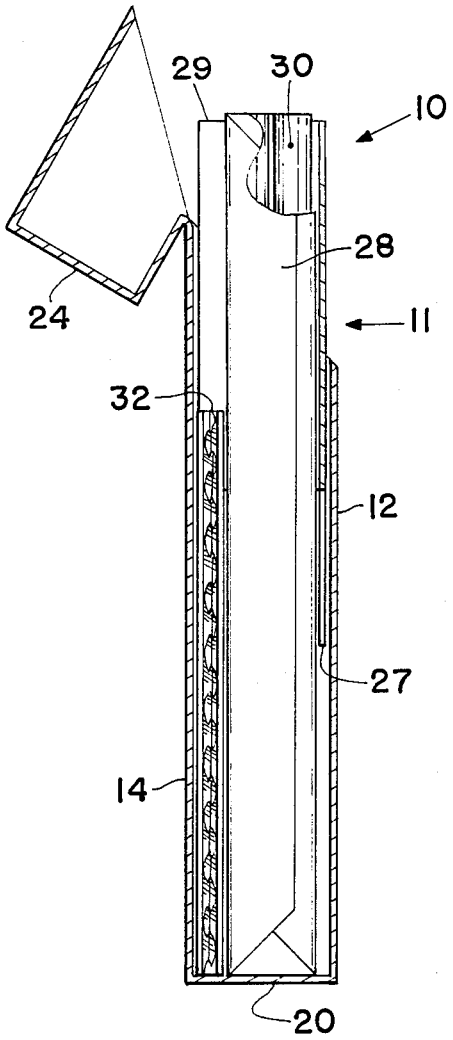
FIG. 2 is a transverse cross-sectional view of the cigarette package of FIG. 1 of the present invention.

With reference to FIGS. 1 and 2, there is shown a cigarette package, generally denoted as the numeral 10, including the features of the present invention. The cigarette package 10 is shown as including an outer enclosure or box 11 of conventional construction having spaced apart from and back walls 12 and 14, spaced apart side walls 16 and 18, a bottom end wall 20, and an open top end 22. The package 10 also is shown as including a hinged cover 24 for opening and closing the open top end 22, and an inner frame member 26 located within the box 11. The inner frame number 26 includes a front wall 27 and two side walls 29 folded back at right angles to the front wall 26. The front wall 27 overlaps the front wall 12 of the box 11, and the side walls 29 overlap the side walls 16 and 18 of the box 11.

As is also conventional practice, a foil bundle of grouped cigarettes, generally denoted by the numeral 28, is disposed within the outer enclosure. The foil bundle 28 comprises a plurality of cigarettes 30 enclosed in a foil material 32 to keep the cigarettes 30 fresh.

The cigarettes 30 shown in the drawings are of a circumferential dimension smaller than are more conventional cigarettes, and the package 10 is of a size dictated by the requirement that a tax stamp be placed on one of the top or bottom ends of the package. Therefore, the smaller than typical cigarettes 30 when packaged in a conventional number within the package 10 do not completely fill the package 10.

A spacer 32 is installed between the foil bundle of grouped cigarettes 28 and back wall 14 of the package 10 to fill the space not occupied by the foil bundle 28. The spacer 32 is planar and of a thickness sufficient to take up the remaining space in the package 10. The spacer 32 is as wide as the interior of the package 10 between the side walls 16 and 18. In addition, as shown bent in FIG. 2, the height of the spacer 32 is less than the height of the package 10 measured from the bottom end 20 to the top edge of the back wall 14 of the package 10. Thus, with the bottom edge of the spacer 32 abutting the bottom end wall 20 of the package 10, the top edge of the spacer 32 is recessed below the elevation of the top edge of the package back wall 14.

Figure 3:
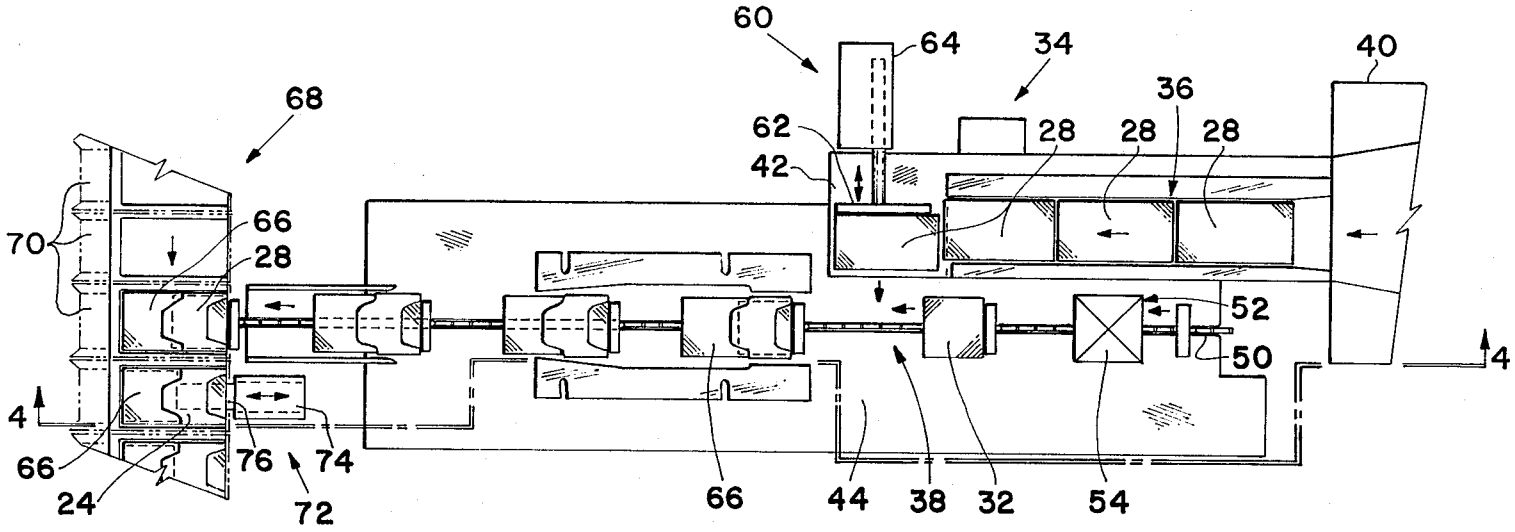
FIG. 3 is a plan view of an apparatus of the present invention for installing an insert in a cigarette package; and, FIG. 4 is a side view of a portion of the apparatus of FIG. 3.
Figure 4:
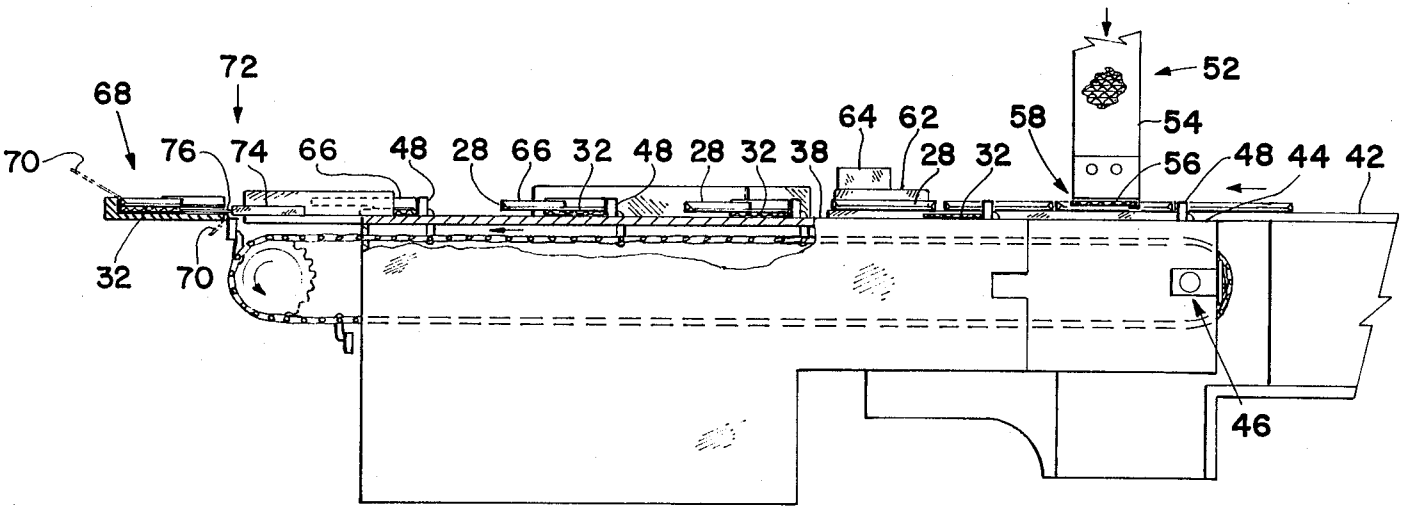

Now with reference to FIGS. 3 and 4, there is shown in schematic an apparatus, generally denoted as the numeral 34 for installing a spacer 32 in the package 10. The apparatus 34 comprises a first conveyor path 36 and a second conveyor path 38. The upstream end of the first conveyor path 36 is located to receive foil bundles of cigarettes 28 from a foil bundle forming device 40. The foil bundle forming device 40 per se does not form a part of the invention and is of a known conventional design. Therefore, for the sake of brevity and clearness of understanding of the present invention, the bundle forming device 40 will not be further described. The first conveyor path 26 extends in a horizontal direction away from the foil bundle forming device 40 to convey a single file row of foil bundles 28 thereon. As shown, the first conveyor path 26 comprises a planar stationary slide plate 42 upon which the foil bundles 28 slide. The foil bundles 28 on the slide surface are moved by being pushed therealong by following on foil bundles 28 which are being deposited on the upstream end of the first conveyor path 36 from the foil bundle forming device 40. The second conveyor path 38 is substantially horizontal and parallel to the first conveyor path 36 and longitudinally offset from the first conveyor path 36 such that the downstream end of the first conveyor path 36 longitudinally overlaps the upstream end of the second conveyor path 38. The second conveyor path 38 also comprises a planar stationary slide plate 44. As can be best visualized in FIG. 4, the first conveying path 36 is at a higher elevation than is the second conveying path 38. Preferably, the difference in elevation corresponds to the thickness of a spacer 32. The second conveying path 38 further comprises an endless conveyor chain device 46 having a plurality of outwardly extending legs 48 affixed to the endless chain. The planar stationary slide plate 44 is formed with a longitudinally extending slot 50, and the endless chain device 46 is positioned beneath the slide plate 44 with its top chain flight in longitudinal alignment with the slot 50 so that the lugs 48 on the top chain flight extend upwardly through the slot 50 above the slide surface of the slide plate 44.

Spacer deposit means, generally denoted as the numeral 52, is located at the second conveyor path 38 for depositing spacers 32 on the second conveyor path 38 one at a time so that a single file of spacers 32 will move on the second conveyor path 38. As shown, the spacer deposit means 52 comprises a hopper or magazine 54 containing a supply of a stack of spacers 32. The bottom end of the hopper 54 is open and includes a pair of flanges 56 which extend the hopper bottom across the open bottom end to prevent the spacers 32 from falling out of the hopper bottom end. The flanges 56 are spaced from the bottom end of the hopper 54 by a distance approximately equal to the thickness of a spacer 32 and defines a spacer exit slot 58 at the front of the hopper 54, and are spaced apart from each other by a distance sufficient to allow the lugs 48 of the endless conveyor chain 46 to pass therebetween.

As the endless conveyor device 46 moves, successive lugs 48 pass the bottom end of the hopper 54 between the pair of flanges 56 contacting the bottom most one of the spacers 32, pushing the bottom most spacer from the hopper 54 through the spacer exit slot 58 onto the slide surface of the slide plate 44, and moving the spacers 32 along the slide surface of the slide plate 44.

The apparatus 34 further comprises means 60 for transferring the foil bundles 28 from the first conveyor path 36 to the second conveying path 38 in overlaying relationship stacked on top of the spacers 32 moving on the second conveyor path 38. As shown best in FIG. 3, the transfer means 60 comprises a pusher plate 62 mounted at the downstream end of the first conveyor path 36 movable back and forth transversely of the first conveyor path 36 toward and away from the second conveyor path 38. The pusher plate 62 can be activated by virtually any device such as, for example, a pneumatic cylinder device 64, or the like. When a foil bundle 28 is positioned at the transfer means 60 at the downstream end of the first conveyor path 36 and a spacer 32 is located on the second conveyor path 38 transversely of the second conveyor path 38 in alignment with the foil bundle 28 at the pusher means 60, the pneumatic cylinder device 64 is activated moving the pusher plate 62 transversely of the first conveyor path 36. The pusher plate 62 pushes the foil bundle 28 from the first conveyor path 36 onto the spacer 32 on the second conveyor path 38 in alignment with the transfer means 60. The lugs 48 of the endless conveyor device 46 of the second conveyor path 38 move the sets of stacked spacers 32 and foil bundles 28 along the second conveyor path 38 to the next work station.

The next work station, generally denoted as the numeral 66, is a conventional device well known in the art for installing the package inner frame member 26 on the foil bundle of grouped cigarettes 28. The inner frame member installing device 66 folds the side walls 29 downwardly at right angles to the front wall 27 of the inner frame member 28, and places the inner frame member 28 on the foil bundle 28 with the front wall 27 on the top side of the foil bundle 28 and the frame side walls 29 extending downwardly over the sides of the foil bundle 28. The inner frame installing device 66 is of well known an conventional construction and does not form a part of the present invention. Therefore, for the sake of brevity and clearness of understanding of the present invention, the inner frame installing device 66 will not be further described.

After leaving the inner frame installing device 66, the foil bundle 28 enclosed in the inner frame 26 is transferred to a boxing apparatus generally denoted as the numeral 68, whereat the sub-assembly of a foil bundle 28, and spacer 32 enclosed in the inner frame 26 is installed in the box 11 to form a package 10. As is typical, the foil bundle 28 is placed on a box blank 70, and the box blank 70 is folded around the foil bundle 28 to form the box 11 enclosing the foil bundle 28. The boxing apparatus 68 is of well known and conventional construction and does not form a part of the present invention. Therefore, for the sake of brevity and clearness of understanding of the present invention, the boxing apparatus 68 will not be further described.

As can be best seen in FIG. 3, when the sub-assembly of a foil bundle 28, spacer 32 and inner frame 26 is placed on a box blank 70 at the boxing apparatus 68, the spacer 32 is located with its top edge in alignment with the top side of the foil bundle 28 such that when installed in the box 11, the top edge of the spacer 32 would be in alignment with the top edge of the package back wall 14. In order to provide for the spacer 32 to be positioned in the package 10 with the spacer bottom edge in abutment with the bottom end wall 20 of the package end and the spacer top edge to be recessed below the elevation of the top edge of the package back wall 14, the position of the spacer 32 on the box blank 11 must be changed. This is accomplished by spacer moving means 72 located at the boxing apparatus 68. The spacer moving means 72 is shown as a pneumatic cylinder device 74 having a flat blade 76 attached to its operating rod. When the pneumatic cylinder device 72 is activated, the blade 76 is moved into contact with what will be the top edge of the spacer 32 and pushes the spacer 32 underneath the foil bundle 28 a predetermined distance until the bottom edge of the spacer 32 is in alignment with the bottom side of the foil bundle 28. Thus, when the box blank 70 is subsequently folded to form the box 11 of the package 10, the top edge of the spacer 32 will be recessed below the elevation of the top edge of the package back wall 14.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A cigarette package comprising:

an outer enclosure having spaced apart front and back walls, spaced apart side walls, a bottom end wall, on open top end, and a cover hinged to the top edge of the back wall for closing the open top end;

a foil bundle of grouped cigarettes located within the outer enclosure, but not completely filling the enclosure between the front wall and back wall thereby leaving a space between the foil bundle of cigarettes and the back wall of the outer enclosure; and, a planar spacer located within the outer enclosure between the foil bundle of grouped cigarettes and the back wall of the outer enclosure, the spacer having a thickness sufficient to take up the remaining space between the front wall and back wall not occupied by the foil bundle of cigarettes and having a width substantially equal to the width of the outer enclosure between the side walls of the enclosure whereby said spacer is intact during removal of said cigarettes.

2. The cigarette package of claim 1 wherein the top edge of the spacer is recessed beneath the elevation of the top edge of the adjacent enclosure wall.

3. A cigarette package comprising:

an outer enclosure having spaced apart front and back walls, spaced apart side walls, a bottom end wall, an open top, and a cover hinged to the top edge of the back wall for closing the open top end;

a foil enclosed bundle of grouped cigarettes located within the outer enclosure, the width of the foil bundle being substantially equal to the width of the enclosure between the enclosure side walls and the thickness of the foil bundle being smaller than the thickness of the enclosure between the enclosure front wall and back wall; and, a planar spacer located within the outer enclosure between the foil bundle and the back wall of the outer enclosure, the spacer having a thickness substantially equal to the difference between the thickness of the foil bundle and the thickness of the enclosure, a width substantially equal to the width of the enclosure between the enclosure side walls, and a height less than the height of the enclosure measured from the enclosure bottom end wall to the top edge of the enclosure back wall, and the planar spacer being in abutment with the bottom end wall of the enclosure such that the spacer is recessed below the top edge of the enclosure back wall whereby said spacer is intact during removal of said cigarettes.

* * * * *